United States Patent [19]

Whitson

[11] 4,197,607

[45] Apr. 15, 1980

[54] POWER DRIVEN SWEEPER

[75] Inventor: Donald W. Whitson, Scott City, Kans.

[73] Assignee: All-Phase Electronics Inc., Scott City, Kans.

[21] Appl. No.: 3,310

[22] Filed: Jan. 15, 1979

[51] Int. Cl.[2] ..... A47L 11/19; A47L 11/24

[52] U.S. Cl. ..... 15/4; 15/49 R; 15/93 R; 30/276

[58] Field of Search ..... 15/49 C, 79 R, 79 A, 15/82, 4, 93 R; 30/276, 347

[56] References Cited

U.S. PATENT DOCUMENTS

| | | | |
|---|---|---|---|
| 1,349,167 | 8/1920 | Pattosien | 15/49 C X |
| 1,901,670 | 3/1933 | Riebel, Jr. et al. | 49 C/ |
| 2,171,075 | 8/1939 | Blazier | 15/79 A X |
| 2,199,615 | 5/1940 | Casper | 15/49 C X |
| 2,489,399 | 11/1949 | Claytor | 15/4 X |
| 2,749,564 | 6/1956 | Tally | 15/79 A |
| 2,842,788 | 7/1958 | Rench et al. | 15/49 C X |

*Primary Examiner*—Edward L. Roberts
*Attorney, Agent, or Firm*—Edwin H. Crabtree

[57] ABSTRACT

A wheel mounted power driven sweeper for cleaning hard to clean floors such as hardened animal manure from animal houses, concrete slabs in feed lots, of any other type application requiring a sweeper for cleaning material therefrom. The sweeper characterized by having a plurality of circular brushes mounted thereon in combination with circular cutting knives disposed adjacent said brushes. The sweeper further characterized by having an adjustable front wheel for adjusting the height of the brushes and cutting knives above the floor surface.

5 Claims, 5 Drawing Figures

POWER DRIVEN SWEEPER

BACKGROUND OF THE INVENTION

This invention relates generally to a power driven sweeper which is power driven and pushed by hand and more particularly, but not by way of limitation, to a wheel mounted sweeper having circular brushes and circular cutting knives for cleaning hardened material on the floor surface such as dried animal manure or any other similar material therefrom.

Heretofore there have been various types of sweepers driving brushes in a circular motion such as the sweepers disclosed in U.S. Pat. No. 3,115,654 to Zimmerman and U.S. Pat. No. 3,732,590 to Horst. Also there have been floor polishers having rotary brushes for polishing floors such as the device disclosed in U.S. Pat. No. 2,014,626 to Moorehead. There have also been floor sweepers having rotary brushes such as the sweeper disclosed in U.S. Pat. No. 3,106,733 to LeCounte et al.

None of the above sweepers or polishers disclose the novel features of the power driven sweeper which is disclosed herein.

SUMMARY OF THE INVENTION

The subject invention can be used for cleaning hard to clean floor surfaces such as found in animal houses, feedlots, or the like. Also the sweeper may be used for cleaning flat storage bins, buildings, or for cleaning snow from driveways and sidewalks.

The power driven sweeper greatly reduces time and labor in cleaning animal pens, houses, barns and feedlots, since it will quickly remove hardened manure or any other type of material which has become attached to the floor surface.

The sweeper is easy to operate and may be driven by an electric motor, gasoline motor, or any other suitable power means. The invention includes the unique feature of circular brushes in combination with circular cutting knives which coact in removing hardened material stuck to the floor surface.

The invention also includes the added feature of a front wheel which is vertically adjustable for adjusting the height of the circular brushes above the floor surface. This allows the sweeper to be lowered when the ends of the brushes become worn. Also the adjustable wheel allows for the adjustment of the cutting knives above the floor surface so that the knives can be properly adjusted depending on the thickness of material and the type of material being removed from the floor surface.

The power driven sweeper further includes the feature of being able to remove the cutting knives quickly from the sweeper when it is desired to use the circular brushes alone for cleaning and removing material such as snow from sidewalks or driveways.

The power driven sweeper for cleaning a floor surface or the like includes a frame mounted on a pair of rear wheels and an adjustable front wheel having a vertical wheel arm attached to the front of the frame. A sweeper handle is attached to the rear of the frame and includes an L-shaped switch handle mounted thereon which coacts with a limits switch which is wired to a relay housing on the handle. The relay housing is connected to an electric motor mounted on the frame. The electric motor is coupled to a drive gearbox mounted on the frame. The gear box includes a pair of drive shafts extending outwardly from the opposite sides of the gearbox. Mounted on the two drive gear shafts are circular brushes and circular cutting knives. When the electric motor is activated by the L-shaped switch handle, the drive shafts rotate the circular brushes and cutting knives for removing material from the floor surface. The sweeper further includes a shield mounted on top of the frame and above the circular brushes and cutting knives to prevent material from flying backwards and hitting the operator of the sweeper as the circular brushes and cutting knives clean material from the floor surface.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
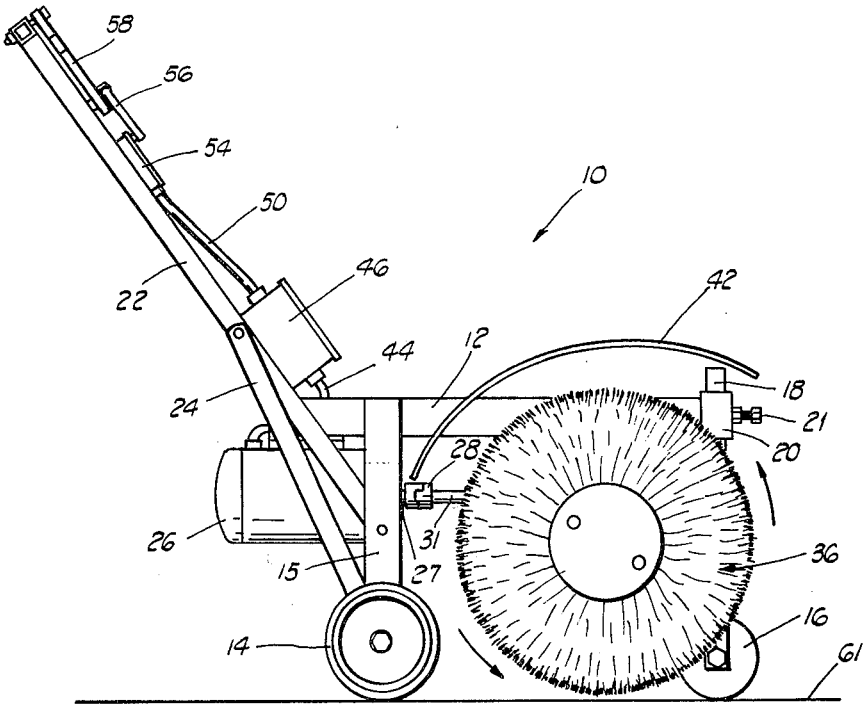
FIG. 1 is a side view of the power driven sweeper.
Figure 2:
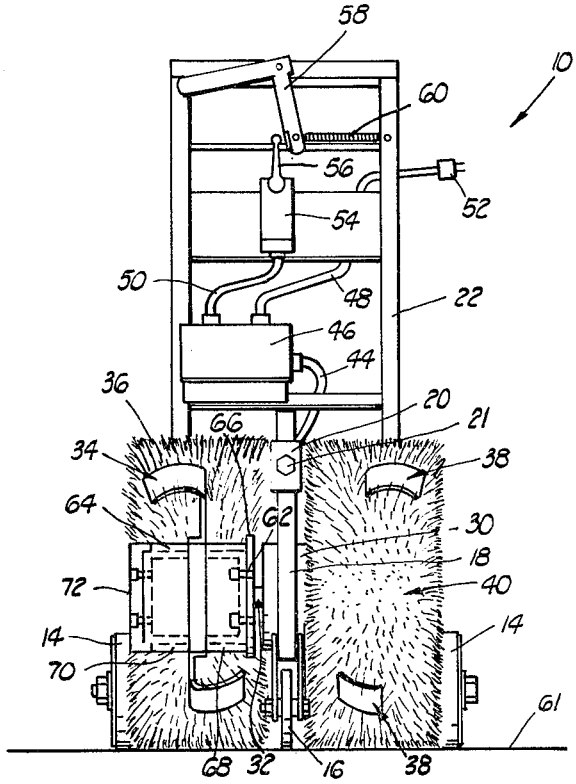
FIG. 2 is a front view of the power driven sweeper.

Referring to both FIGS. 1 and 2, the power driven sweeper is designated by general reference numeral 10. The sweeper 10 includes a frame 12 mounted on a pair of rear wheels 14 having rear wheel supports 15 and an adjustable front wheel 16 which is attached to a vertical wheel arm 18 slidably received in a wheel arm sleeve 20 attached to the front of the frame 12. The arm 18 is secured in the sleeve 20 by a locking bolt 21. Mounted on the rear of the frame 12 is a sweeper handle 22 having handle braces 24 attached to the rear wheel supports 15.

Figure 3:
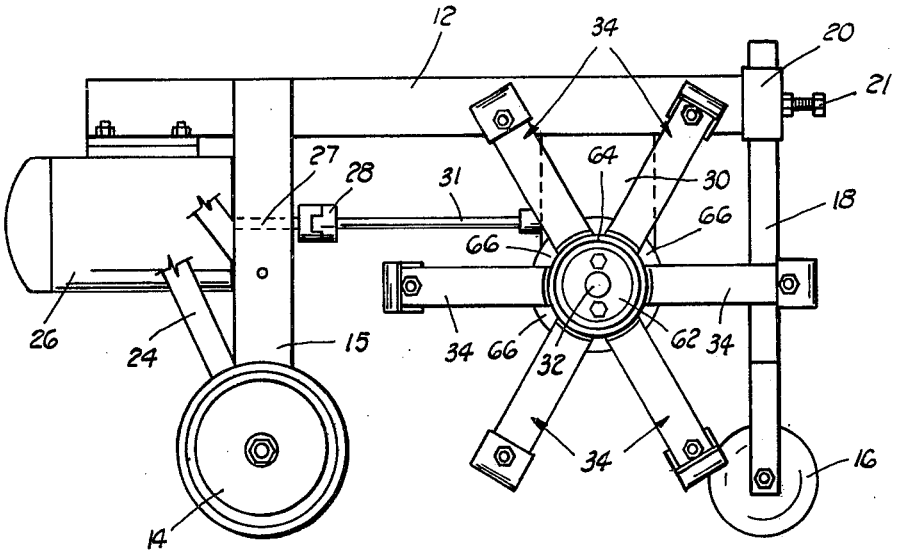
FIG. 3 is an enlarged side view of the wheel mounted frame of the power driven sweeper with the circular brushes removed therefrom.

The sweeper 10 further includes a drive means such as an electric motor 26 attached to the rear of the frame 12. While the electric motor 26 is shown it can be appreciated that a gasoline engine, a hydraulic motor, air motor, or any other drive means could be used equally well. The electric motor 26 includes a drive shaft 27 attached to a coupling 28. The coupling 28 is attached to a drive gearbox 30 by a coupling shaft 31. The gearbox 30 can be seen in FIGS. 2 and 3. The drive gearbox 30 is suspended from the center of the frame 12 and includes a first horizontal drive shaft 32 and a second horizontal drive shaft extending outwardly from the opposite sides of the drive gearbox 30. The first horizontal drive shaft 32 is shown in FIGS. 2 and 3. The second horizontal drive shaft is hidden behind the brushes in FIG. 2. Mounted on the first drive shaft 32 is a first circular cutting knife 34 and a first circular brush 36. Shown in FIG. 2 on the opposite sides of the sweeper 10 and attached to the second horizontal drive shaft is a second circular cutting knife 38 and a second circular brush 40.

Disposed above the brushes and knives and attached to the top of the frame 12 is a shield 42 to prevent material removed from the floor by the sweeper 10 from flying backwards and contacting the operator while the sweeper 10 is in operation.

The electric motor 26 is connected by an electrical lead 44 to a relay housing 46. The relay housing 46 includes a pair of electrical leads 48 and 50. The electric lead 48 includes an electric plug 52 for connecting to any standard alternating current outlet. The second electric lead 50 is attached to a limit switch 54 having a limit switch arm 56 which coacts with an L-shaped switch handle 58 pivotally mounted on the end of the handle 22. The switch handle 50 is biased away from the limit switch arm 56 by a spring 60. When it is desired to operate the sweeper 10 the switch handle 58 is lifted upwardly by the operator of the sweeper 10 pivoting a portion of the handle 58 downwardly contacting the limit switch arm 56 and closing the limit switch 54 which in turn activates the electric motor 26 through a relay disposed in the relay housing 46. Should it be desired to turn the sweeper 10 off, the operator merely releases the switch handle 58 and the spring 60 biases the handle 58 away from the limit switch arm 56 which opens the limit switch 54 and turns off the power supply to the electric motor 26.

In FIG. 1 it can be seen that the height of the brushes 36 are adjusted just above a floor surface 61. By raising and lowering the adjustable wheel arm 18 in the wheel arm sleeve 20 the height of the circular brushes and cutting knives can be adjusted accordingly depending on the type of material to be cleaned from the floor surface 61.

In FIG. 2 a front view of the sweeper 10 can be seen with a portion of the brushes 36 cut away on the left hand side of the drawing exposing the first horizontal drive shaft 32 extending outwardly from the drive gearbox 30. The first horizontal shaft 32 includes a hub plate 62 which is attached to a circular drum 64 having an annular flange 66 therearound. The first circular brush 36 is split in half and includes a first half 68 and a second half 70. The first half 68 is received around the drum 64 and positioned against the flange 66. The first circular cutting knife 38 is then positioned around the circular drum 64 with the second half 70 positioned against the opposite side of the cutting knife 34. A flange plate 72 is then bolted to the end of the circular drum 64 compressing the two halves 68 and 70 of the circular brush 36 with the cutting knife 38 therebetween against the annular flange 66. The second circular brush 40 is also split in half and mounted with the second circular cutting knife 38 on the second horizontal shaft similar to the above described brush 36 and knife 34.

In FIG. 3 the frame 12 of the sweeper 10 is shown with the brushes 36 and 40 removed. The first circular cutting knife 34 can be seen mounted around the circular drum 64 with flange 66. Looking through the circular drum 64 the first horizontal drive shaft 32 is shown attached to hub plate 62 which in turn is attached to the circular drum 64. In operation the circular cutting knives 34 and 38 can be quickly removed from the drum 64 should it be desired to remove material using the sweeper 10 without the cutting knives.

Also seen in this view is the drive shaft 27 extending outwardly from the electric motor 26 and attached to the coupling 28. The coupling 28 is attached to the coupling shaft 31 which in turn is connected to the gearbox 30.

Figure 4:
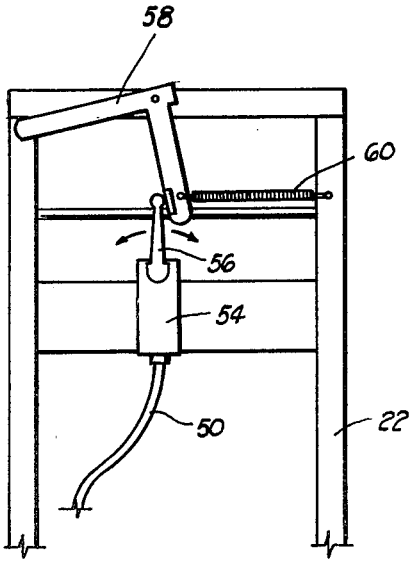
FIG. 4 is an enlarged front view of the sweeper handle.

In FIG. 4 the upper half of the handle 22 of the sweeper 10 is shown to more clearly illustrate the L-shaped switch handle 58 which is biased to the right by spring 60 to prevent the switch handle 58 from contacting the switch arm 56. When the upper portion of the handle 58 is gripping the lower portion of the handle 58, it moves in a clockwise direction contacting the switch arm 56 and moving it to the left thereby closing the limit switch 54 and activating the electric motor 26. Should the switch handle 58 for any reason be released by the operator of the sweeper 10 the spring 60 biases the lower portion of the handle 58 away from the switch arm 56 which moves to the right thereby opening the limit switch 54 and shutting off the electric power to the electric motor 26.

Figure 5:
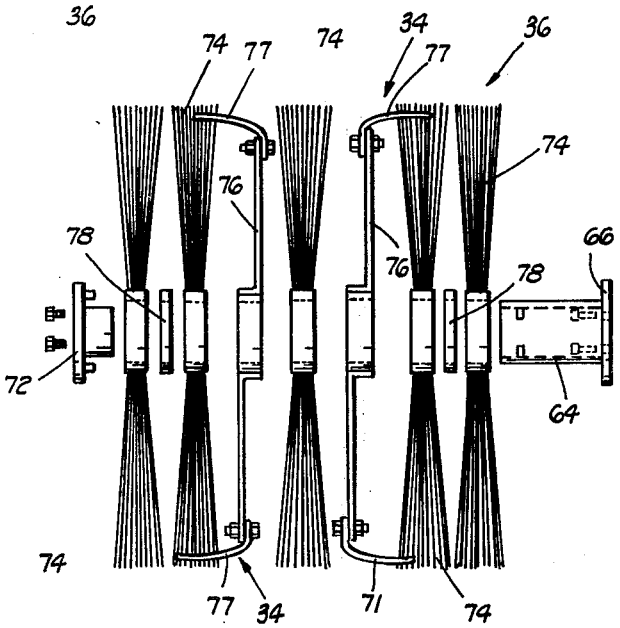
FIG. 5 is a front view of the sweeper's circular brushes and one of the sweeper's circular cutting knives.

In FIG. 5 a front view of the circular brush 36 and circular cutting knife 34 is illustrated removed from the horizontal drive shaft 32 of the gearbox 30. In this view the circular brush 36 is divided in five individual brushes 74. The circular cutting knife 34 can be seen divided into two knives 76 having cutting blades 77. The blades 77 extend outwardly at opposite directions and at right angles to the length of the circular cutting knives 76 for receipt in the outer periphery of the circular brushes 74. Two of the brushes 74 are positioned on the right hand side of the knives 76 and two brushes 74 are on the left hand side. The brushes 74 are separated by a spacer 78. The fifth brush 74 is positioned between the two knives 76.

On the right hand side of FIG. 5 the circular drum 64 with annular flange 66 is shown in a position to be inserted through the center of the brushes 74 and the circular cutting knives 76. When the brushes 74 and the circular cutting knives 76 are received on the drum 64 they are held thereon and against the annular flange 66 by the flange plate 72 which is bolted to the end of the circular drum 64. It should be appreciated while the cutting knives 34 and 38 and brushes 36 and 40 are shown, various combinations and pluralities of knives and brushes could be mounted on the drive shaft 32 and fall within the scope of the invention.

Changes may be made in the construction and arrangement of the parts or elements of the embodiments as described herein without departing from the spirit or scope of the invention defined in the following claims:

What is claimed is:

1. A power driven sweeper for cleaning a floor surface or the like, the sweeper comprising:

a frame;

a pair of rear wheels attached to the rear of the frame;

a sweeper handle attached to the rear of the frame;

switch means mounted on the sweeper handle;

a first circular brush mounted on a first horizontal drive shaft, the first drive shaft extending outwardly from one side of a drive gearbox attached to the frame;

a first circular cutting knife disposed adjacent the first circular brush and mounted on the first drive shaft, the first knife having a cutting blade extending outwardly at right angles from the end of the knife for receipt in the outer periphery of the first circular brush;

a second circular brush mounted on a second drive shaft extending outwardly from the opposite side of the gearbox;

a second circular cutting knife disposed adjacent the first circular brush and mounted on the second drive shaft, the second knife having a cutting blade extending outwardly at right angles from the end of the knife for receipt in the outer periphery of the second circular brush; and drive means mounted on the frame and coupled to the gearbox for rotating the first and second brushes and the first and second cutting knives;

said switch means connected to the drive means for turning the drive means on and off during the operation of the sweeper.

2. The sweeper as described in claim 1, wherein the first and second cutting knives each include a pair of knives extending outwardly from each other and having cutting blades extending at right angles from the ends of the knives and at opposite directions from each other.

3. A power driven sweeper for cleaning a floor surface or the like, the sweeper comprising:

a frame;

a pair of rear wheels attached to the rear of the frame;

a sweeper handle attached to the rear of the frame;

switch means mounted on the sweeper handle;

a first drive shaft extending outwardly from one side of a drive gearbox attached to the frame;

a second drive shaft extending outwardly from the opposite side of the gearbox;

circular drums attached to the first drive shaft and the second drive shaft;

a plurality of circular brushes slidably received around the circumference of the circular drums and releasably attached thereto;

a plurality of circular cutting knives slidably received around the circumference of the circular drums and releasably attached thereto; and drive means mounted on the frame and coupled to the gearbox for rotating the brushes and cutting knives;

the switch means connected to the drive means for turning the drive means on and off during the operation of the sweeper.

4. The sweeper as described in claim 3, wherein the cutting knives include cutting blades extending outwardly at right angles from the end of the knives for receipt in the outer periphery of the circular brushes.

5. The sweeper as described in claim 3, wherein the circular drums include an angular flange at one end therearound, the circular brushes and circular knives held on the drums between the angular flange and a flange plate secured to the opposite end of the drums.

* * * * *